United States Patent [19]

Morris

[11] Patent Number: 4,936,700

[45] Date of Patent: Jun. 26, 1990

[54] LIQUID ABSORBENT CAP FOR DELIVERY SYSTEM FOR TOILETRIES

[75] Inventor: Edward Morris, Paramus, N.J.

[73] Assignee: American Cyanamid Company, Stamford, Conn.

[21] Appl. No.: 529,423

[22] Filed: Sep. 2, 1983

Related U.S. Application Data

[63] Continuation-in-part of Ser. No. 286,741, Jul. 27, 1981, abandoned.

[51] Int. Cl.[5] ..... B05C 21/00

[52] U.S. Cl. ..... 401/196; 401/202; 401/206; 401/262; 215/348

[58] Field of Search ..... 401/196, 198, 199, 202, 401/213, 261, 262, 263, 265, 206, 207, 266; 220/258; 215/347, 348

[56] References Cited

U.S. PATENT DOCUMENTS

| | | | |
|---|---|---|---|
| 1,949,162 | 2/1934 | Kallenbach | 401/266 |
| 3,132,370 | 5/1964 | Capezzuto | 401/202 |
| 3,349,975 | 10/1967 | Damron | 215/348 |
| 3,610,766 | 10/1971 | Herrhring | 401/261 |
| 3,976,217 | 8/1976 | Dukess | 215/347 |
| 4,057,159 | 11/1977 | Fillmore et al. | 215/347 |
| 4,103,802 | 8/1978 | Piltz et al. | 220/258 |
| 4,111,567 | 9/1978 | Berghahn et al. | 401/202 |
| 4,151,924 | 5/1979 | Jameson | 215/347 |
| 4,244,481 | 1/1981 | Kornelis | 215/348 |
| 4,480,940 | 11/1984 | Woodruff | 401/206 |

*Primary Examiner*—Robert P. Swiatek
*Assistant Examiner*—Carolyn A. Harrison
*Attorney, Agent, or Firm*—Charles J. Fickey

[57] ABSTRACT

A liquid absorbent cap means fitting over the applicator surface of a device for applying liquid materials to the skin with a poromeric applicator surface.

6 Claims, 2 Drawing Sheets

FIG. 3
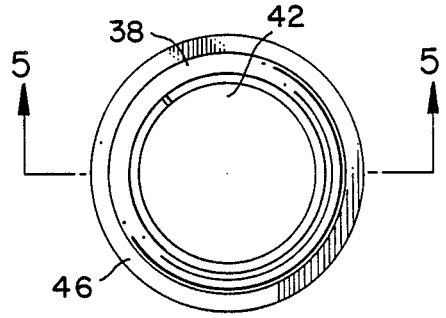
FIG. 1
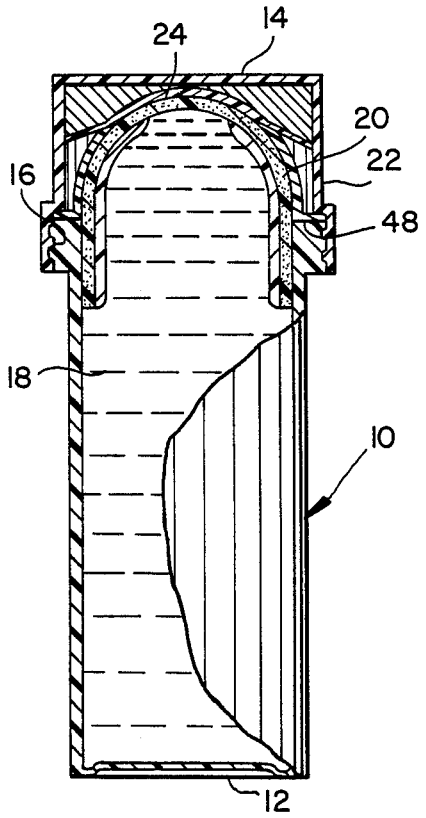
FIG. 4
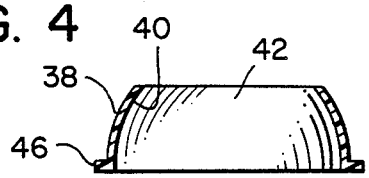
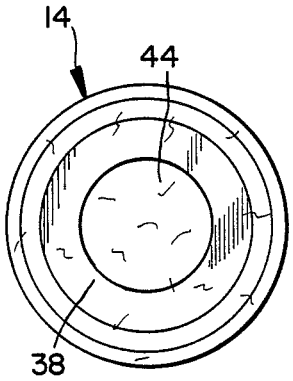
FIG. 5
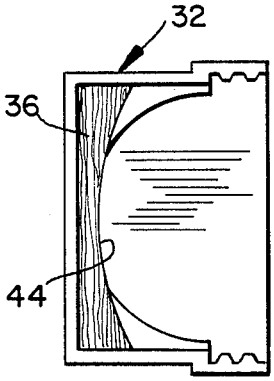
FIG. 6
FIG. 2
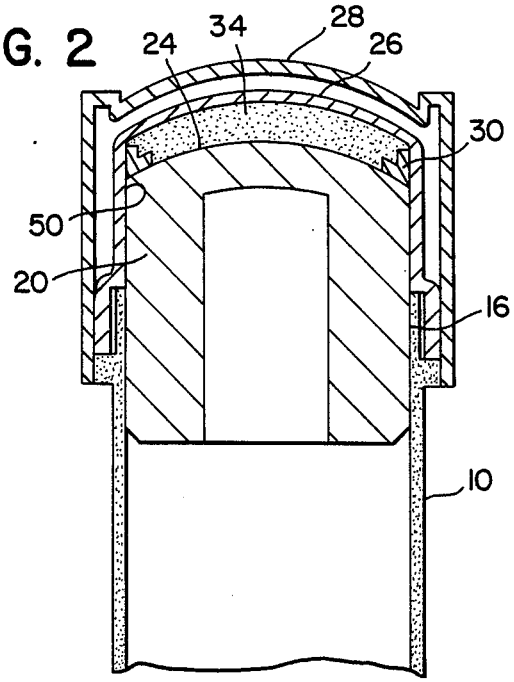
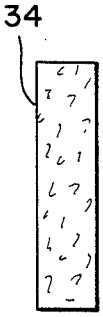
FIG. 8
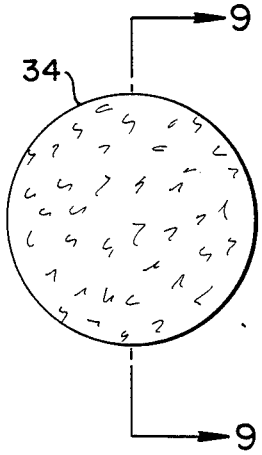
FIG. 7

LIQUID ABSORBENT CAP FOR DELIVERY SYSTEM FOR TOILETRIES

This application is a CIP of copending application Serial No. 286,741,filed July 27, 1981, and now abandoned.

The present invention relates to a liquid absorbent cap for a liquid applicator for dispensing toiletries to the skin, particularly antiperspirants and deodorants to the human axilla.

Liquid applicators in general are well-known in the prior art, particularly the roll-on type commonly for antiperspirants and deodorants. These are disclosed, for example, in U.S. Pat. Nos. 2,749,566; 2,923,957; and 2,998,616. Because of problems with roll-on type applicators, Berghahn et al., U.S. Pat. Nos. 4,050,826 and 4,111,567, devised a liquid applicator comprising a container fitted with a head having a fixed, shaped form made of a non-flexible, nondeformable, sintered porous synthetic plastic resin having a controlled porosity and having omni-directional, interconnecting pores. The liquid overflow problems associated with conventional roll-ons is also present with this type of head and is solved by the provision of a liquid collecting channel adjacent the shaped applicator, permitting the excess liquid to drain back via the channel into an opening through the head into the liquid reservoir. This avoids an accumulation of liquid on the surface of the applicator and resulting crystallization of product being delivered.

In a real sense, the porous plastic applicator of Berghahn et al. resembles the conventional roll-on applicator except that it is stationary and has a drain channel. The liquid product being delivered must be brought into contact with the applicator head in order for the liquid to be delivered to the surface by capillary action. This requires inverting the container, as is true of the roll-on type of head, since there will always be dead space between the liquid in the reservoir and the applicator head.

In commonly assigned, copending application Serial Number 183,515, filed Sept. 2, 1980, and now abandoned, is disclosed a delivery system for liquid toiletry products whereby a liquid product is absorbed into an absorbent material which is in intimate contact with a non-flexible, non-deformable, sintered, porous synthetic plastic resin applicator head having a controlled porosity and omni-directional interconnecting pores, and whereby the absorbed liquid product is continuously delivered to the porous applicator head by capillary flow on demand.

The device of the copending application has the advantage of eliminating dead air space and the need to invert the container, since the liquid is always in contact with the applicator head and available on demand at the surface of the applicator head.

The applicator head of the copending application is of any suitable configuration, and a convex outer surface has been found to be particularly suitable for contact with various parts of the human body. Thus the applicator head could have a hemispherical shape, either solid or hollow.

The materials which are used to make the shaped applicator head are non-flexible, non-deformable, sintered, porous synthetic resins having a controlled porosity and having omni-directional interconnecting pores, formed of aggregates of united polymer particles.

The degree of porosity of the porous materials can be controlled in their manufacture, thus insuring a wide range of porosity to suit a wide range of liquid products of varying viscosities. Sintered, porous applicator heads may be fabricated of high-density polyethylene, low-density polyethylene, ultra-high molecular weight polyethylene, polypropylene, polyvinylidene fluoride, and the like. Products are available commercially under the trade designations "Porex" porous plastics and "Porous Poly". The pore size of the applicator may vary widely, depending on the liquid to be delivered. Low-viscosity liquids, such as perfumes, may best be delivered via a small-pore plastic applicator, e.g., one micron or less. In general, the pore size may vary between about one to 200 microns, and for most purposes, generally about 10–50 microns are preferred.

Such a delivery device may also incorporate an absorbent material in the reservoir, onto which the liquid to be delivered is adsorbed, and this absorbent material is in direct and intimate contact with the porous applicator head. This causes continuous contact of the liquid with the applicator head and ease of delivery of the liquid on demand by capillary flow. The absorbent material used in the reservoir may be any material capable of absorbing the liquid to be delivered, such as cellulose acetate, polyester, cotton, rayon, nylon, or other suitable material, and capable of transferring the liquid therefrom continuously on demand by capillary flow (wicking). The absorbent material may take any suitable shape or form.

The container may obviously be of any suitable shape and design and may be constructed of any suitable material, such as metal, glass, or plastic and may be rigid or flexible.

This delivery system may be used to deliver any topical liquid product to the skin. These may include, for example, after-shave lotions, pre-shave lotions, skin lubricants or emollients, suntan lotions, fragrances (perfumes, colognes, etc.), topical therapeutics (analgesics, acne formulations, antiseptics, etc.), and the like. The delivery system is particularly useful in applying antiperspirants and deodorants and avoids the problems associated with roll-on applicators. Thus, the invention provides a means of applying a low viscosity, fast drying, non-sticky solution of aluminum chlorhydrate, avoiding the undesirable features of roll-ons, pump sprays, and sticks.

Since the porous plastic materials are hydrophobic and do not "wet" with water, it may be necessary to add alcohol to an antiperspirant formula to transfer the product from the container to the applicator head. Crystallization of the solid components of the solution, such as aluminum chlorhydrate, may be avoided by the addition of certain esters, such as isopropyl myristate or isopropyl palmitate.

Although the applicator package of copending application Serial No. 183,515,described above, provides an excellent means of applying liquid products, due to the porous nature of the applicator head, fluid or vapor may pass through the head when this is not desired.

The present invention provides a sealing cap designed to be used with porous plastic applicators to serve as an absorptive reservoir for all fluid and vapor which by-passes the porous applicator during standing and traveling and especially when stored at temperatures greater than room temperature (approx. 72° F.).

The invention provides an absorbent holding area for fluid which has escaped through the applicator which would otherwise leak out from under the cap via the threads. This is especially apparent when the container is stored in the inverted position. Vapors which pass through the applicator condense in the cap and is likewise held in the absorbent media.

The primary function of over-caps, used on containers of all sizes and shapes, is to serve as a temporary closure for the container, preventing foreign matter from entering the container and to prevent evaporation of the product within the container. In addition to the aforementioned functions, the invention serves as a means of containing all of the fluid within the total package, thereby preventing leakage or dripping of fluid out of the package. The absorbent media will take on approximately 75% of its weight of fluid at which time an equilibrium will take place, i.e., the passage of fluid out of the applicator equals the passage of fluid back into the container. This is especially true at higher temperatures. When restored to room temperature, the fluid held in the cap passes back into the container (except for approximately ½gram).

The invention consists of a threaded plastic overcap into which is placed an absorbent material capable of absorbing hydroalcoholic or anhydrous alcoholic antiperspirant solutions. The absorbent material is held in position against the upper, inner surface of the cap, for example by means of a circular hemispherically shaped plastic member. The hemispherically shaped plastic member has an opening cut into the apex, measuring approximately 1¼" in diameter, serving as an opening to receive the apex of the applicator. The curvature of the hemispherically shaped plastic member is identical to the curvature of the applicator so as to provide for an intimate fit. The tip of the applicator which passes through the opening in the hemispherically shaped plastic member, comes into direct contact with the absorbent media, so as to create a curved impression in the absorbent media.

The circular hemispherically shaped plastic member serves to guide or direct the fluid which passes out through the applicator, towards the absorbent media. The plastic member can be constructed out of any suitable plastic material such as polyethylene, polypropylene, or polyvinyl chloride. The absorbent media can be constructed of any suitable absorbent material such as:

1. Cotton (bleached or unbleached)
2. Rayon fibers
3. Wood pulp
4. Urethane foam
5. Cellulose acetate fibers
6. Other paper deravatives
7. Nylon fibers
8. Polyester fibers Nylon is a preferred material.

The absorbent material can be woven, felted or unconsolidated fibers. In addition, the absorbent material can be resilient and conform to the applicator head under compression. On the other hand the absorbent material can be non-resilient, in which case it will be manufactured so that its surface conforms to that of the applicator head. A suitable non-resilient material would be the same porous plastic as the applicator head. Other suitable non-resilient materials are urethane foam, molded wood pulp, and the like. It will be clear that the absorbent pad should not enter into any chemical reaction with any of the liquid formulation ingredients in the container.

The invention may be better understood by reference to the drawings in which,

FIG. 1 is a cross-sectional view in elevation of the liquid absorbent cap of the invention attached to a porous applicator head package with parts broken away to show a cross-section of the case, applicator head and cap;

FIG. 2 is a partial elevational view in cross-section of an alternative liquid absorbent cap construction;

FIGS. 3 to 8 show different views and elements of the absorbent cap of the invention which may be used with the porous applicator head liquid delivery system;

FIG. 3 is a top plan view of the inner seal of the cap;

FIG. 4 is a cross-sectional view of the inner seal taken along the lines 5—5 of FIG. 3;

FIGS. 5 and 6 are plan and side views respectively of the absorbent member of the cap;

FIG. 7 is a bottom plan view of the inner absorbent member of the cap; and

FIG. 8 is a cross-sectional view of the absorbent member, taken along the lines 9—9 of FIG. 7.

Figure 9:
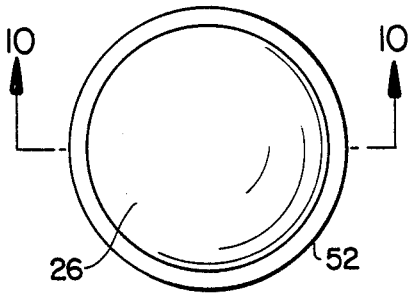
FIGS. 9 to 14 show different views and elements of an alternative construction of the absorbent cap of the invention.
Figure 11:
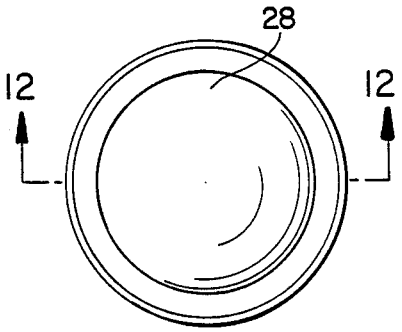
Figure 10:
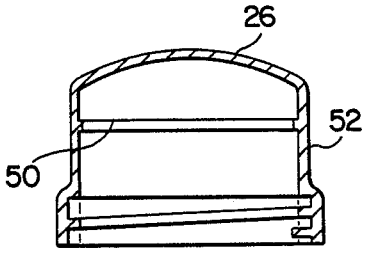
Figure 12:
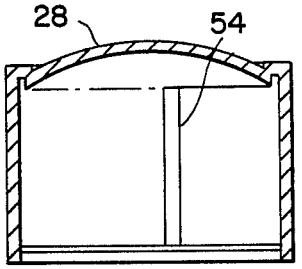
Figure 13:
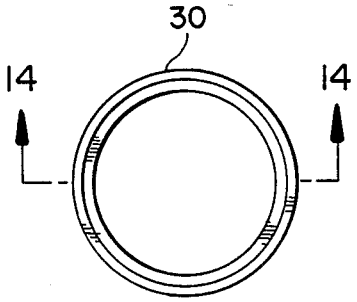
Figure 14:
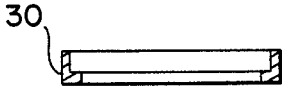

FIGS. 9 and 10 respectively show top plan view of an inner cap element and cross—sectional view in elevation, taken along the lines 10—10 of FIG. 9;

FIGS. 11 and 12 respectively show top plan view of the outer cap element and cross-sectional view taken along the lines 12—12 of FIG. 11; and FIGS. 13 and 14 respectively show top plan view of a snap ring fitting in inner cap element and cross-sectional view thereof taken along the lines 14—14 of FIG. 13.

Referring to the Figures, a typical porous applicator head liquid delivery system comprises an outer case 10 having a base 12 and a cap 14 which is attached by means of threads 16 at the top of case 10. It will be understood that cap 14 could be attached by a friction fit also. Case 10 contains the liquid product 18 to be dispensed. The liquid product may be absorbed in an absorbent material, not shown, if desired. A porous plastic applicator head 20 is fitted into the open end 22 of case 10. In the embodiment shown the applicator head 20 has a hemispherical outer surface 24 and is hollow inside.

The inventive cap 14 may be of any suitable configuration and may be friction fit, although it has been shown as a threaded fit.

The cap structure is shown in FIGS. 4 through 9. Cap 14 comprises a cylindrical body 32, which may be plastic, glass, metal or the like. An absorbent layer 34 is fitted into the top area 36 of cap 14. Absorbent layer 34 is secured in place by holding ring 38, which is fitted immediately above threads 16 of cap 14 and may be friction fitted or adhesively secured. Holding ring 38 is made of a suitable plastic, and has a generally hemispherical inner surface 40, conforming to the outer surface 24 of dispenser head 20 with the apex cut out to leave opening 42, exposing an area 44, of absorbent layer 34, and allowing area 44 to contact dispenser head 20 when cap 14 is affixed to case 12. Ring 38 has a flange 46 at its lower periphery which seats against the upper edge 48 of case 10. When cap 14 is threaded onto case 10, the inner surface 40 of holding ring 38 fits tightly against the outer surface 24 of porous applicator head 20, and flange 46 fits tightly against upper edge 48 of case 10, thus preventing leakage of liquid from under cap 14. Any excess liquid on the surface 24 of applicator head 20 will be absorbed by absorbent layer 34 in area 44 exposed by the opening 42 in holding ring 38, since layer 34 is of sufficient thickness to fit closely over the apex of applicator head surface 24. In addition, any vapors or liquids which pass through porous head 24 due to a rise in temperature above ambient and consequent expansion of the contents in case 10, or when the case is tipped from the vertical position, will be absorbed by layer 34 as previously described.

An alternative embodiment of the inventive cap is shown in FIGS. 2 and 9 to 14. The cap comprises an inner threaded cap member 26 and an outer cap member 28. Inner cap member 26 is a low density plastic material e.g., polyehtylene or polypropylene, such that threads 16 are slightly deformable and form a tight fit. An absorbent pad 34 fits in the upper portion of inner cap 26 and is held in place by a snap ring 30 which snaps in beyond an annular bead 50 around the inner surface of cap 26. Outer cap 28 fits over inner cap 26 and is secured thereto by any suitable means such as vertical grooves 52 in the outer surface of cap 26 and vertical grooves 54 on the inner surface of cap 28, so that rotation of outer cap 28 also turns inner cap 26 to remove it from the threaded end of container 10. It will be understood that any suitable means could be used to secure outer cap 28 to inner cap 26, and also that the inner cap 26 could fit on container 10 by a friction fit without threads.

Outer cap 28 is made of a high density plastic, e.g., polyethylene, polypropylene or polystyrene, which can be molded or machined to closer tolerances and present a more aesthetic appearance on the package. The porous head 20 of the applicator in FIG. 2 is flatter than that of FIG. 1, but absorbent pad 34 will conform to the shape of head 20 regardless of configuration if it is a resilient construction. If pad 34 is of a non-resilient material, it will be manufactured to conform to head 20.

Thus, by the use of a composite cap having an inner cap of a softer plastic and an outer cap of a harder plastic, it is possible to obtain good sealing properties while also obtaining a pleasing appearance on the outside.

It may also be possible to omit the holding ring 30 for the absorbent pad 34 and have the pad retained in the cap solely by friction or adhesive means.

The composite cap of FIG. 2 functions in the same manner as that of FIG. 1 in preventing leakage of liquid under all conditions.

Although the absorbent pad 34 has been shown as circular to fit within the cap, it may also take various shapes, while still retaining the function of retaining the liquids and vapors passing through head 20. Pad 34 could for example be square, oval, multi-sided, or even ring shaped with a central opening, so long as it has sufficient absorptive capacity.

What is claimed is:

1. In combination with a liquid container having a porous plastic applicator head having omnidirectional capillary liquid passages, a liquid impervious closure cap adapted to fit on the top of said container, said cap having an absorbent pad in the crown thereof, said pad being positioned and having a configuration to be in contact with a substantial area of said applicator head when said cap is fitted onto said container, wherein, when said cap is on said container; said pad acts to absorb liquid or vapor from said liquid container, and to give up absorbed liquid to said porous applicator head in response to change in relative pressures inside and outside said container.

2. The cap of claim 1 wherein said cap is made of a plastic material and is threaded to fit on said container.

3. The cap of claim 1 wherein said pad is held in place by an annular ring fitted within said cap.

4. The cap of claim 1 wherein said cap comprises an inner cap of low density plastic material, said pad being within said inner cap and an outer cap of high density plastic material is fitted over said inner cap.

5. The cap of claim 4 wherein said pad is held in place by an annular ring fitting within said inner cap.

6. The cap of claim 1 wherein said absorbent pad is made of nylon fibers.

* * * * *